US009257748B1

(12) United States Patent
Lalezari et al.

(10) Patent No.: US 9,257,748 B1
(45) Date of Patent: Feb. 9, 2016

(54) BROADBAND, LOW-PROFILE ANTENNA STRUCTURE

(71) Applicant: FIRST RF Corporation, Boulder, CO (US)

(72) Inventors: Arian C. Lalezari, Boulder, CO (US); Farzin Lalezari, Boulder, CO (US)

(73) Assignee: FIRST RF Corp., Boulder, CO (US)

( * ) Notice: Subject to any disclaimer, the term of this patent is extended or adjusted under 35 U.S.C. 154(b) by 352 days.

(21) Appl. No.: 13/836,699

(22) Filed: Mar. 15, 2013

(51) Int. Cl.

| | |
|---|---|
| ***H01Q 21/30*** | (2006.01) |
| ***H01Q 5/00*** | (2015.01) |
| ***H01Q 5/15*** | (2015.01) |
| ***H01Q 5/25*** | (2015.01) |

(52) U.S. Cl.
CPC ..... *H01Q 5/0093* (2013.01); *H01Q 5/15* (2015.01); *H01Q 5/25* (2015.01); *H01Q 21/30* (2013.01)

(58) Field of Classification Search
CPC ..... H01Q 5/00; H01Q 5/15; H01Q 5/25; H01Q 21/30; H01Q 5/0093; H01Q 2/25
USPC ..... 343/767, 725, 730, 829, 729
See application file for complete search history.

(56) References Cited

U.S. PATENT DOCUMENTS

| | | | | |
|---|---|---|---|---|
| 5,187,489 | A * | 2/1993 | Whelan | H01Q 13/085 343/767 |
| 5,428,364 | A * | 6/1995 | Lee | H01Q 13/08 343/767 |
| 5,557,291 | A * | 9/1996 | Chu | H01Q 5/42 343/725 |
| 6,900,770 | B2 * | 5/2005 | Apostolos | H01Q 9/26 343/725 |
| 7,554,507 | B2 * | 6/2009 | Kwon | H01Q 7/00 343/793 |
| 2004/0169609 | A1 * | 9/2004 | Song | H01Q 1/241 343/767 |
| 2005/0024281 | A1 * | 2/2005 | Apostolos | H01Q 9/26 343/767 |
| 2006/0208954 | A1 * | 9/2006 | Han | H01Q 1/38 343/767 |
| 2007/0188399 | A1 * | 8/2007 | Rickenbrock | H01Q 1/36 343/803 |
| 2009/0262036 | A1 * | 10/2009 | Thevenard | H01Q 1/38 343/767 |
| 2011/0057852 | A1 * | 3/2011 | Holland | H01Q 9/28 343/795 |
| 2014/0306854 | A1 * | 10/2014 | Flores-Cuadras | H01Q 5/0027 343/722 |

* cited by examiner

*Primary Examiner* — Dameon E Levi
*Assistant Examiner* — Jennifer F Hu
(74) *Attorney, Agent, or Firm* — Christopher J. Kulish

(57) ABSTRACT

The invention is directed to a broadband, low-profile antenna structure that in one embodiment includes a compound radiator and a ground plane. The compound radiator is comprised of a dipole radiator portion and a Vivaldi radiator portion that is electrically connected to the dipole radiator portion. In operation, the dipole radiator portion operates in the lower end of the bandwidth and the Vivaldi radiator portion operates in the upper end of the bandwidth.

22 Claims, 7 Drawing Sheets

BROADBAND, LOW-PROFILE ANTENNA STRUCTURE

FIELD OF THE INVENTION

The invention relates to an antenna structure that has a broad bandwidth (i.e., the ratio of the highest frequency ($f_{high}$) in the bandwidth to the lowest frequency ($f_{low}$) in the bandwidth is at least 3:1) and a low-profile.

BACKGROUND OF THE INVENTION

There is a need for a broadband or broad bandwidth, low-profile antenna. The bandwidth of an antenna is typically defined as the difference between the low frequency ($f_{low}$) and high frequency ($f_{high}$) at which the power output of the antenna is within 3 dB of the maximum power output of the antenna. In a broadband or broad bandwidth antenna, the ratio of $f_{high}$ to $f_{low}$ is greater than 3:1. The profile of an antenna that includes a ground plane and one or more radiators that are all located to one side of the ground plane refers to a plot of the shortest distance between each point associated with the radiators and the ground plane. For a broadband antenna to be considered to be low-profile, the maximum distance in the profile must be less than $\lambda/2$ at $f_{low}$.

An example of a broadband, high-profile antenna can be found in currently known synthetic-aperture radars. The antenna in such a radar is a single-beam antenna that is capable of broadband performance, mounted to a moving platform (e.g., an aircraft), and used to obtain high spatial resolution images of a target region. To elaborate, the antenna is used to transmit pulses of radio signals of varying wavelengths within the bandwidth and receive echo waveforms that are coherently detected and subsequently processed to obtain a high spatial resolution image of the target region. Currently, the known single-beam, broadband antennas that are used in such radar systems have a high profile (i.e., greater than $\lambda/2$ at $f_{low}$) that is disadvantageous. For example, a high profile limits the application of the antenna to moving platforms that have the space to accommodate the profile of the antenna. A high profile can also adversely affect the operation of the moving platform with which antenna is associated. For example, if the antenna is associated with an aircraft, the high profile may require that a significant portion of the antenna project beyond the normal "skin" of the aircraft and to an extent that adversely affects the aerodynamics of the aircraft.

SUMMARY OF THE INVENTION

Many types of antennas are known to exhibit a broad bandwidth and a high profile. Among these antennas are: quad-ridge horn, log periodic dipole array, Vivaldi, and log conical spiral antennas. Also known are antennas that have a narrow bandwidth and a low-profile. These antennas include dipole, slot, microstrip patch, and planar inverted-F antennas. However, an antenna structure that has both a broad bandwidth (greater than 3:1) and a low-profile (height less than $\lambda/2$ at $f_{low}$) has proven to be elusive.

The invention is directed to a broadband, low-profile antenna structure that includes a compound radiator and a ground plane located adjacent to the radiator. The compound radiator includes a dipole radiator portion and a Vivaldi radiator portion that is electrically connected to the dipole radiator portion. In operation, the dipole radiator portion operates in the lower end of the bandwidth and, when operating in the lower end of the bandwidth, is fed by the Vivaldi radiator portion (i.e., the Vivaldi radiator portion transmits/receives electrical signals to/from the dipole radiator portion). The Vivaldi radiator portion operates in the upper end of the bandwidth and receives/transmits electrical signal from/to a radio via whatever signal transmission structure extends between the Vivaldi radiator portion and the radio. The low-profile is attributable to the distance between any point associated with the dipole radiator portion or the Vivaldi radiator portion (i.e., a radiator point) and the point on the ground plane that is nearest to any such a radiator point being less than $\lambda/2$ at $f_{low}$. Further, the antenna structure is capable of being adapted to achieve profiles that are substantially less than $\lambda/2$ at $f_{low}$. For example, a profile as low as $0.15\lambda$ at $f_{low}$ has been achieved.

In one embodiment, the compound radiator is comprised of a pair of dipole sub-radiators and a pair of Vivaldi sub-radiators. Each of the dipole sub-radiators extends from an inner terminal end to an outer terminal end. The inner terminal ends of the dipole sub-radiators are separated from one another by a first distance and the outer terminal ends of the dipole sub-radiators are separated from one another by a second distance that is greater than the first distance. The second distance is approximately $\lambda/2$ at $f_{low}$. In another embodiment, this second distance is reduced so as to be less than $\lambda/2$ at $f_{low}$ and greater than or equal to $\lambda/4$ at $f_{low}$. If the footprint of the antenna structure is defined by the dipole radiator portion and not the ground plane, which can theoretically have an infinite extent, this embodiment of the antenna structure can be used to realize a reduced footprint for the antenna structure.

In a further embodiment, the compound radiator is comprised of first and second dipole sub-radiators and first and second Vivaldi sub-radiators. The first dipole sub-radiator and first Vivaldi sub-radiator are embodied in a single piece of electrically conductive material. For example, the first dipole sub-radiator and first Vivaldi sub-radiator can be formed from a single piece of copper that has been appropriately shaped to realize a dipole structure and a Vivaldi structure. In a further embodiment, the first and second dipole sub-radiators, first and second Vivaldi sub-radiators and ground plane are all embodied in a single piece of electrically conductive material.

DETAILED DESCRIPTION

Figure 1A:
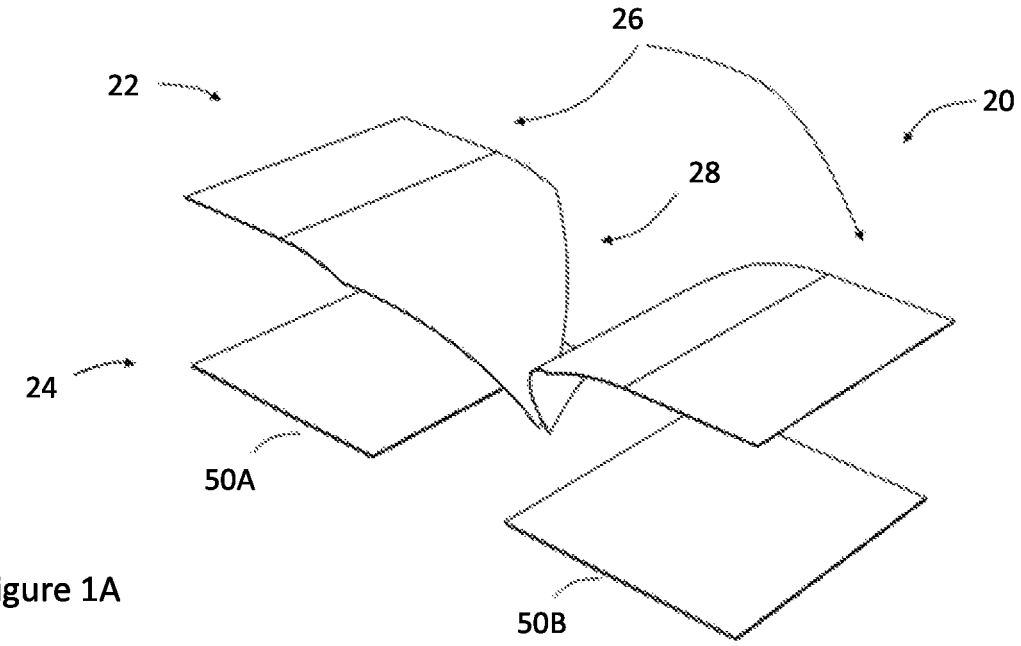
FIGS. 1A-1C respectively are perspective, side, and top views of an embodiment of a broadband, low-profile antenna structure.
Figure 1B:
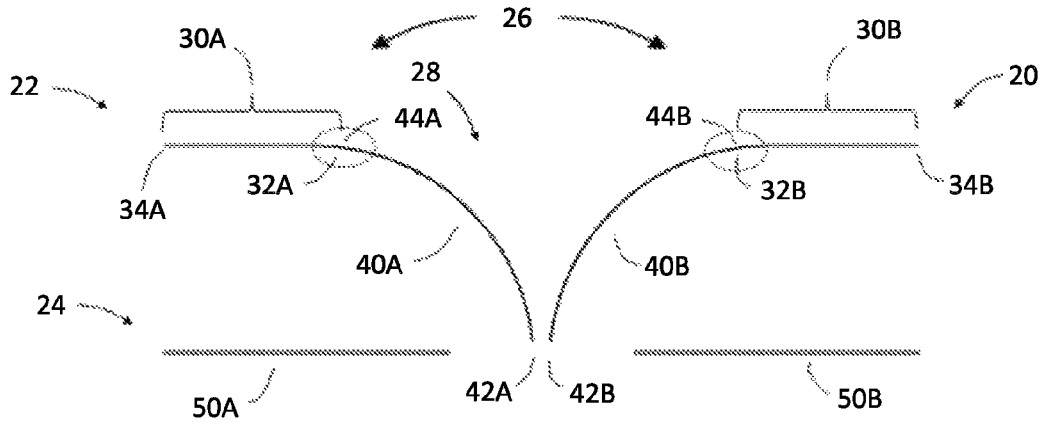
Figure 1C:
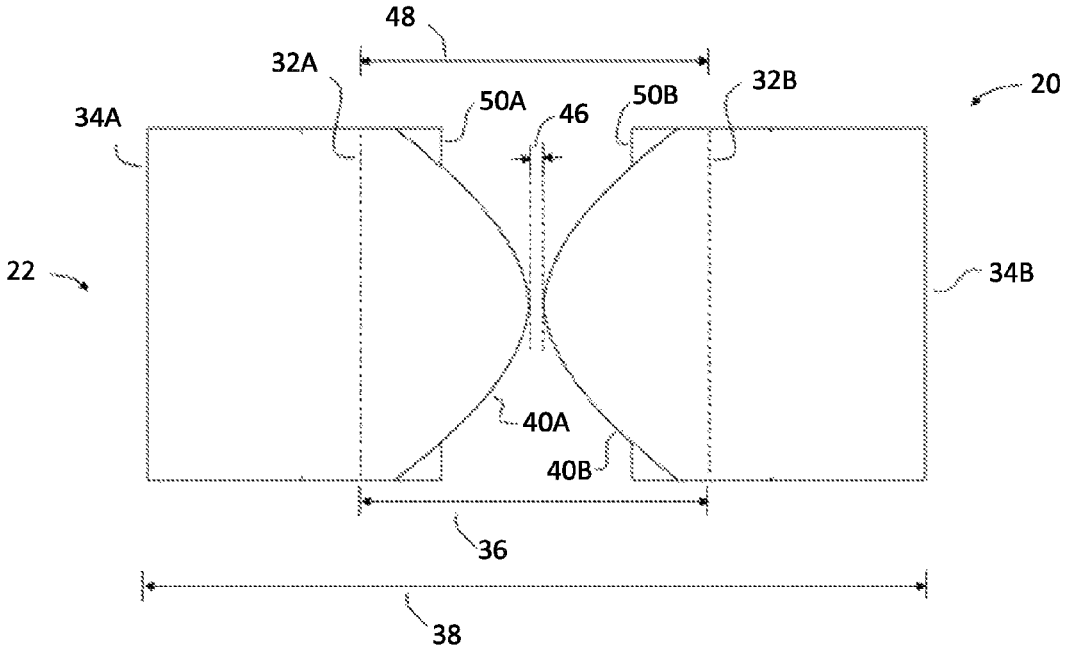

With reference to FIGS. 1A-1C, an embodiment of a broadband, low-profile antenna structure 20 (hereinafter "antenna 20") is described. The antenna 20 includes a compound radiator 22 and a ground plane 24 that is located adjacent to the compound radiator. More specifically, the compound radiator 22 is located such that the entire radiator is located to one side of the ground plane 24.

The compound radiator 22 is comprised of a dipole radiator 26 and a Vivaldi radiator 28 that is electrically connected to the dipole radiator. In operation, the compound radiator 22 is capable of broadband operation, i.e., capable of operating over a bandwidth with at least a 3:1 ratio. More specifically, the dipole radiator 26 of the compound radiator 22 operates in the lower end of the bandwidth and the Vivaldi radiator 28 of the compound radiator 22 operates in the upper end of the bandwidth. Further, it should be appreciated that when the dipole radiator 26 is operating in the lower end of the bandwidth, the Vivaldi radiator 28 functions as feed for the dipole radiator 26, (i.e., transmits/receives electrical signals to/from the dipole radiator). The compound radiator 22 and ground plane 24 present a low-profile, i.e., the maximum distance between any point on the compound radiator and the nearest point on the ground plane to the point of interest on the compound radiator is less than $\lambda/2$ at $f_{low}$.

The dipole radiator 26 is comprised of first and second dipole sub-radiators 30A, 30B that are each planar and substantially co-planar with one another. The first dipole sub-radiator 30A extends from an inner terminal end 32A to an outer terminal end 34A. Likewise, the second dipole sub-radiator 30B extends from and inner terminal end 32B to an outer terminal end 34B. The inner terminal ends 32A, 32B are separated by a distance 36 that is related to a transition region in the bandwidth at which the operation of the antenna moves between dipole and Vivaldi modes of operation. The outer terminal ends 34A, 34B are separated by a distance 38 that is related to the bandwidth of the antenna and is substantially equal to $\lambda/2$ at $f_{low}$. Further, while each of the illustrated dipole sub-radiators 30A, 30B has a planar rectangular shape, dipole sub-radiators with different shapes are feasible. For instance, a dipole sub-radiator in the form of: (a) a wire, (b) a planar triangle, or (c) a planar isosceles trapezoid, as well as other shapes know to those skilled in the art, are each feasible.

The Vivaldi radiator 28 is comprised of first and second Vivaldi sub-radiators 40A, 40B. The first Vivaldi sub-radiator 40A extends from an inner terminal end 42A to an outer terminal end 44A. Likewise, the second Vivaldi sub-radiator 40B extends from and inner terminal end 42B to an outer terminal end 44B. The inner terminal ends 42A, 42B are separated by a distance 46 that presents a desired impedance over the bandwidth of the antenna and is also related to $f_{high}$. The outer terminal ends 34A, 34B are separated by a distance 48 that, in the illustrated embodiment, is substantially equal to the distance 36 between the inner terminal ends 32A, 32B of the dipole radiator 26. With reference to FIG. 1B, each of the Vivaldi sub-radiators has profile that conforms to a plane curve that is a linear, exponential, Klopfenstein, elliptical, polynomial, trigonometric, or hyperbolic curve (to name a few). Further, while the each of the illustrated Vivaldi sub-radiators 40A, 40B is a curved triangular sheet or flared surface with a curve that conforms to a plane curve, Vivaldi sub-radiators with different shapes are feasible. For instance, a Vivaldi sub-radiator in the form of: a wire that conforms to the plane curve, a planar surface with an edge that forms to a plane curve, or other shape know to those skilled in the art are each feasible.

The dipole radiator 26 and the Vivaldi radiator 28 are electrically connected to one another such that the Vivaldi radiator 28 can act as a feed for the dipole radiator 26 when the dipole radiator 26 is active in the lower end of the bandwidth. More specifically, (a) the outer terminal end 44A of the first Vivaldi sub-radiator 40A is electrically connected to the inner terminal end 32A of the first dipole sub-radiator 30A and (b) the outer terminal end 44B of the second Vivaldi sub-radiator 40B is electrically connected to the inner terminal end 32B of the second dipole sub-radiator 30B. In the illustrated embodiment, these connections are achieved by embodying: (a) the first dipole sub-radiator 30A and the first Vivaldi sub-radiator 40A in the same piece of electrically conductive material (e.g., copper) and (b) the second dipole sub-radiator 30B and the second Vivaldi sub-radiator 40B in the same piece of electrically conductive material. As such, (a) the outer terminal end 44A of the first Vivaldi sub-radiator 40A is substantially coextensive with the inner terminal end 32A of the first dipole sub-radiator 30A and (b) the outer terminal end 44B of the second Vivaldi sub-radiator 40B is substantially coextensive with the inner terminal end 32B of the second dipole sub-radiator 30B.

The ground plane 24 is comprised of first and second ground sub-planes 50A, 50B that are each planar and substantially co-planar with one another. The first and second ground sub-planes 50A, 50B respectively underlie the first and second dipole sub-radiators 30A, 30B and operate to reflect the electromagnetic signal produced dipole radiator 26 back towards the dipole radiator 26.

Figure 2:
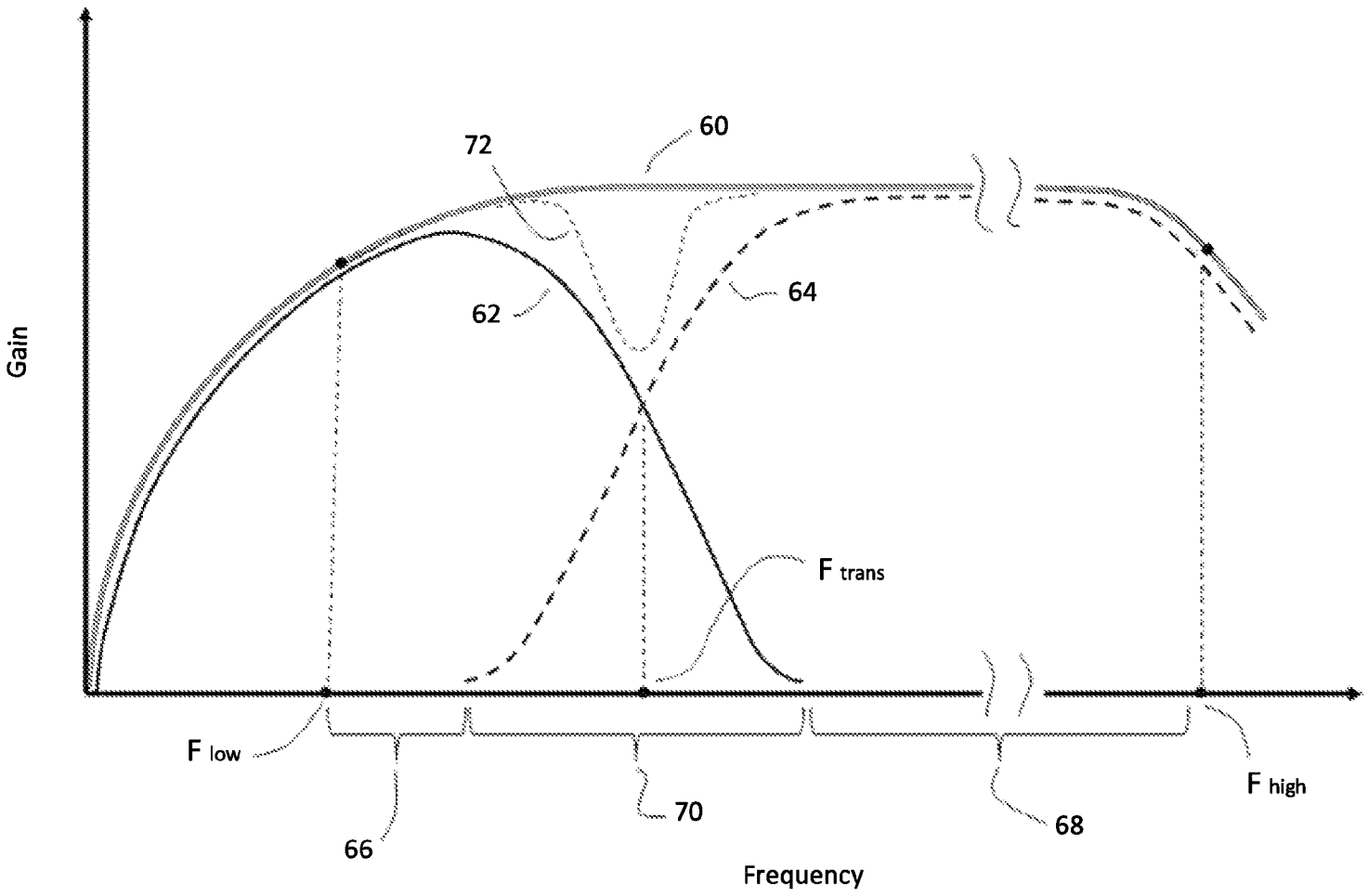
FIG. 2 illustrates the gain v. frequency curves for a dipole radiator, a Vivaldi radiator, and a compound radiator comprised of a dipole radiator and a Vivaldi radiator, such as the compound radiator illustrated in FIGS. 1A-1C.

With reference to FIG. 2, the operation of antenna 20 is described. The antenna 20 operates over a broad bandwidth that is represented by the portion of the gain v. frequency curve 60 that extends from $f_{low}$ to $f_{high}$. The curve 60 is a composite of the portion of the gain v. frequency curve 62 for the dipole radiator 26 for which the frequency is greater than or equal to $f_{low}$ and the portion of the gain v. frequency curve 64 for the Vivaldi radiator 28 for which the frequency is less than or equal to $f_{high}$. While the portions of curve 62 and curve 64 overlap, the dipole radiator 26 has a range of frequencies 66 in which it is operational and the Vivaldi radiator 28 is substantially non-operational and the Vivaldi radiator 28 has a range of frequencies 68 in which it is operational and the dipole radiator 26 is substantially non-operational. As such, when the antenna 20 is operating in the frequency range 66 in the lower portion of the bandwidth, the dipole radiator 26 operates to transmit/receive electromagnetic signals and the Vivaldi radiator 28 is substantially non-operational with respect to the transmitting/receiving of electromagnetic signals but does operate as a feed for the dipole radiator 26. Conversely, when the antenna is operating in the frequency range 68 in upper portion of the bandwidth, the Vivaldi radiator 28 operates to transmit/receive electromagnetic signals and the dipole radiator 26 is substantially non-operational with respect to the transmitting/receiving of electromagnetic signals. The curve 62 and the curve 64 overlap in a range of frequencies 70. In this range of frequencies, both the dipole radiator 26 and the Vivaldi radiator 28 are operational, as such the range of frequencies 70 is identified as the frequencies between which the compound radiator 22 transitions be substantially dipole and substantially Vivaldi modes of operation. Due to this transition region, the inner terminal ends 32A, 32B of the first and second dipole sub-radiators 30A, 30B and the outer terminal ends 44A, 44B of the first and second Vivaldi sub-radiators 40A, 40B are each shown in FIG. 1B as being located within an area of the compound radiator 22. Stated differently, these terminal ends cannot be correlated to a specific point or line on the compound radiator 22 but rather correspond to an area on the compound radiator 22.

In designing the antenna 20 for broadband operation, the curves 62 and 64 must overlap to an extent that avoids a drop in gain at, about, or near a transition frequency ($f_{trans}$) (the frequency at which the curves 62 and 64 intersect) of a magnitude that renders the antenna a narrowband antenna rather than a broadband antenna. For purposes of illustration, a drop in gain 72 is shown in FIG. 2. The drop in gain 72 can be avoided by increasing the upper end of the bandwidth of the dipole radiator 26 and/or decreasing the lower end of the bandwidth of the Vivaldi radiator 28. The upper end of the bandwidth of the dipole radiator 26 can be increased by changing the structure of the radiator. For example, if the dipole radiator 26 is a wire dipole radiator, the wire dipole radiator can be replaced with a bowtie dipole radiator. The lower end of the bandwidth of the Vivaldi radiator 28 can be decreased by increasing the distance between the outer terminal ends 44A, 44B of the first and second Vivaldi sub-radiators 40A, 40B and/or increase the depth of the Vivaldi radiator, i.e., the vertical distance between inner terminal ends 42A, 42B and the outer terminal ends 44A, 44B.

Figure 3:
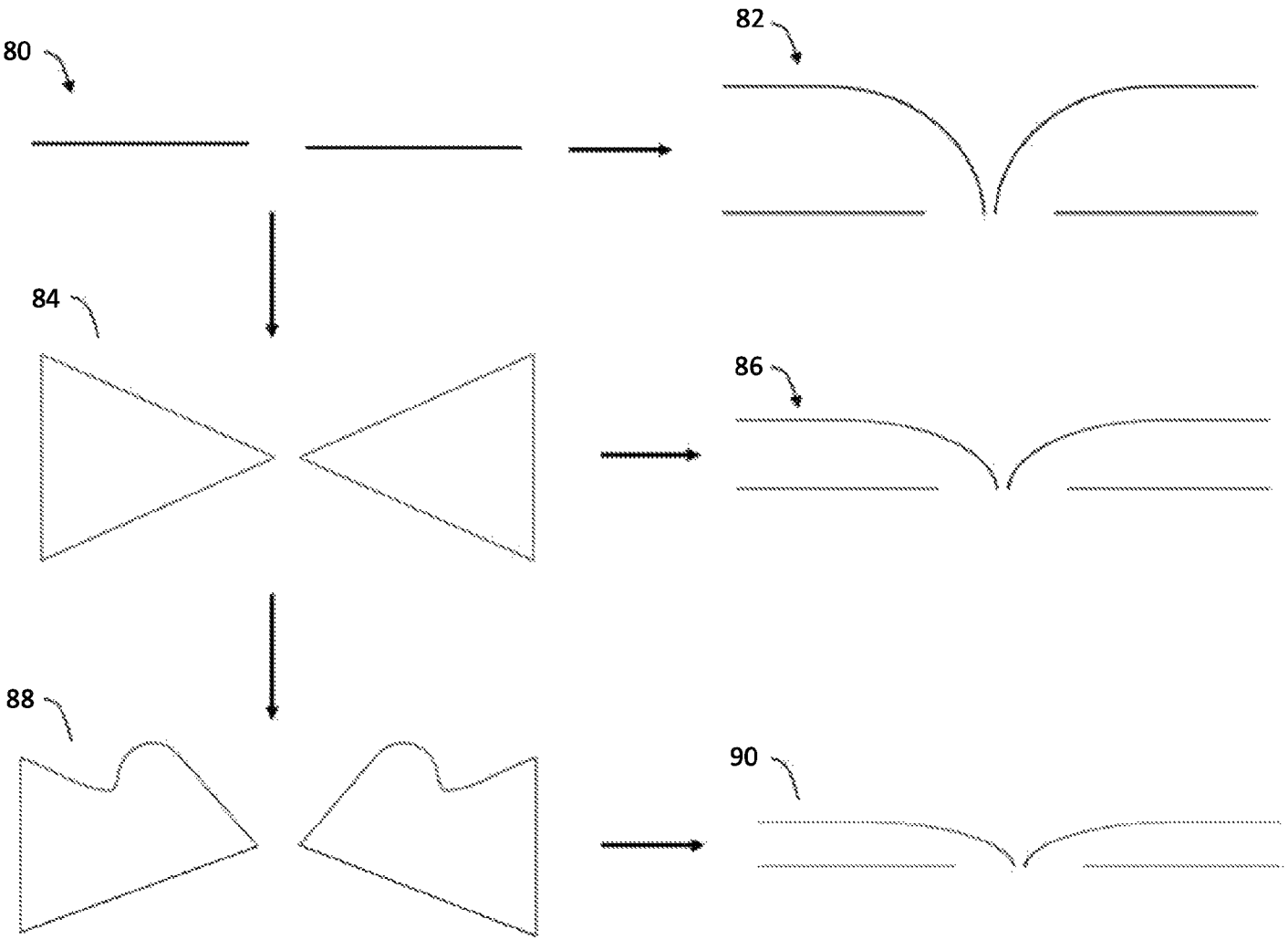
FIG. 3 illustrates a progression of different types of dipoles that can be used to increasingly reduce the portion of the profile of a broadband, low-profile antenna structure attributable to the dipole radiator.

The profile of antenna 20 is less than $\lambda/2$ at $f_{low}$. However, it should be appreciated that the portion of the profile attributable to the dipole radiator portion can fall within a range substantially under the $\lambda/2$ at $f_{low}$ limit based upon the type of dipole radiator employed. With reference to FIG. 3, when a wire dipole radiator 80 is utilized, an antenna structure 82 with a relatively high but still low profile is produced. When a bowtie dipole radiator 84 is employed, an antenna structure 86 with a lower profile relative to the antenna structure 84 is produced. When a spade dipole radiator 88 is employed, an antenna structure 90 with a lower profile related to the antenna structure 86 is produced. Other types of dipole radiators may have similar effects on the profile of the resulting antenna structure. It should be appreciated that, with all other factors being equal, the progression of dipole antenna types from wire dipole to spade dipole also produced dipoles radiators with increasing bandwidths and Vivaldi radiators with decreasing bandwidths.

Figure 4:
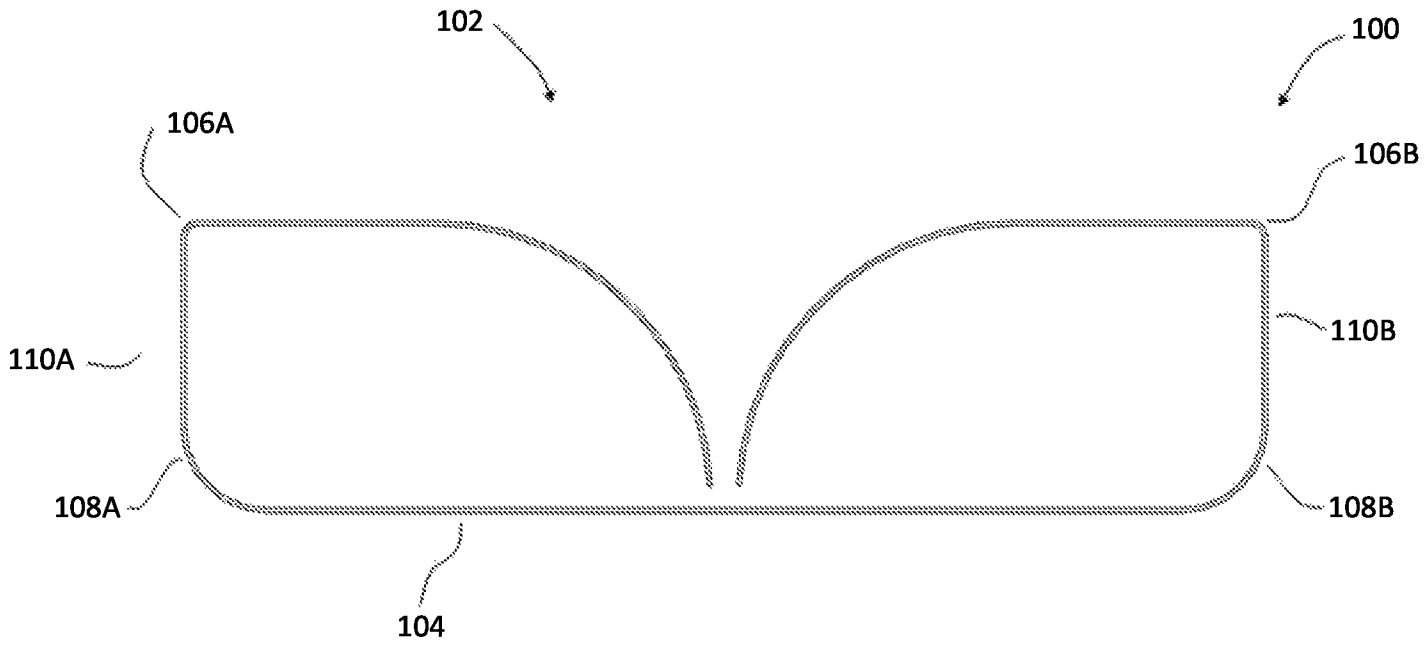
FIG. 4 illustrates a second embodiment of a broadband, low-profile antenna that also has a reduced footprint.

With reference to FIG. 4, a second embodiment of a broadband, low-profile antenna structure 100 (hereinafter "antenna 100") is described. The antenna 100 includes a compound radiator 102 and a ground plane 104. The compound radiator 102 is comprised of a dipole radiator portion and a Vivaldi radiator portion. The dipole radiator portion has outer terminal ends 106A, 106B. The ground plane extends between ground plane terminal ends 108A, 108B. The antenna 100 further includes a first connector 110A that electrically connects the dipole outer terminal end 106A to the ground plane terminal end 108A and a second connect 110B to electrically connect the dipole outer terminal end 106B to the ground plane terminal end 108B. The first and second connects 110A, 110B can each have a resistive, capacitive, or inductive characteristic or a combination of such characteristics. The connectors 110A, 110B allow the distance between the dipole outer terminal ends 106A, 106B to be reduced relative to an antenna where the distance between the dipole outer terminal ends is or approximately is $\lambda/2$ at $f_{low}$ while still maintaining the same $f_{low}$ for the bandwidth. In one embodiment, the distance between the outer dipole ends has been reduced to $\lambda/4$ at $f_{low}$. As such, the antenna 100 has a reduced footprint related dimension with substantially the same bandwidth as an antenna that does not employ connectors comparable to connectors 110A, 110B. Further, it should be appreciated that the compound radiator 102, ground plane 104, and connectors 110A, 110B can be embodied in a single piece of electrically conductive material.

Figure 5:
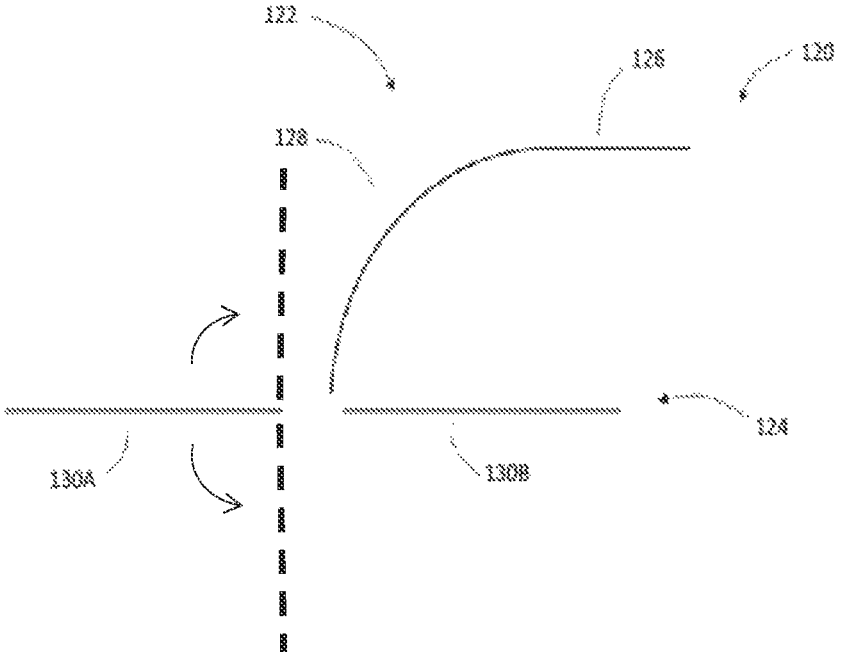
FIG. 5 illustrates a third embodiment of a broadband, low-profile antenna that employs a compound radiator comprised of a monopole radiator and half-Vivaldi radiator.

With reference to FIG. 5, a third embodiment of a broadband, low-profile antenna structure 120 (hereinafter "antenna 120") is described. The antenna 120 is comprised of a compound radiator 122 and a ground plane 124. The compound radiator 122 includes a monopole radiator 126 and a half-Vivaldi radiator 128. The ground plane 124 includes first and second ground sub-planes 130A, 130B. The feed of electrical signals to/from the antenna 120 is to the free end of the half-Vivaldi radiator 128 and the first ground sub-plane 130A. While the first ground sub-plane 130A is shown as being co-planar with the second ground sub-plane 130B, the first ground sub-plane 130A can be oriented in a range that extends from 90° in the clockwise direction from the illustrated orientation to 90° in the counter-clockwise direction from the illustrated orientation.

Figure 6A:
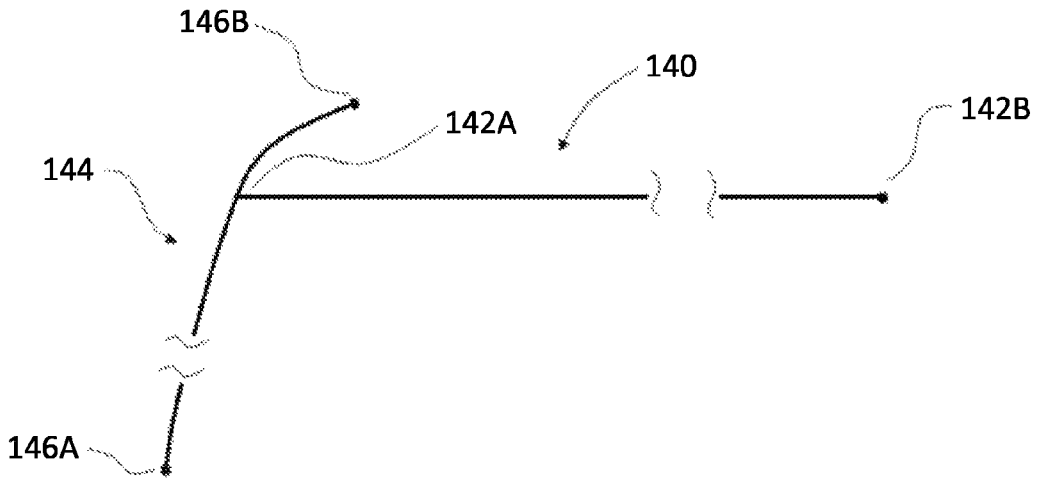
FIGS. 6A-6B illustrate different embodiments of an electrical connection between a dipole/monopole radiator and a Vivaldi/half-Vivaldi radiator.
Figure 6B:
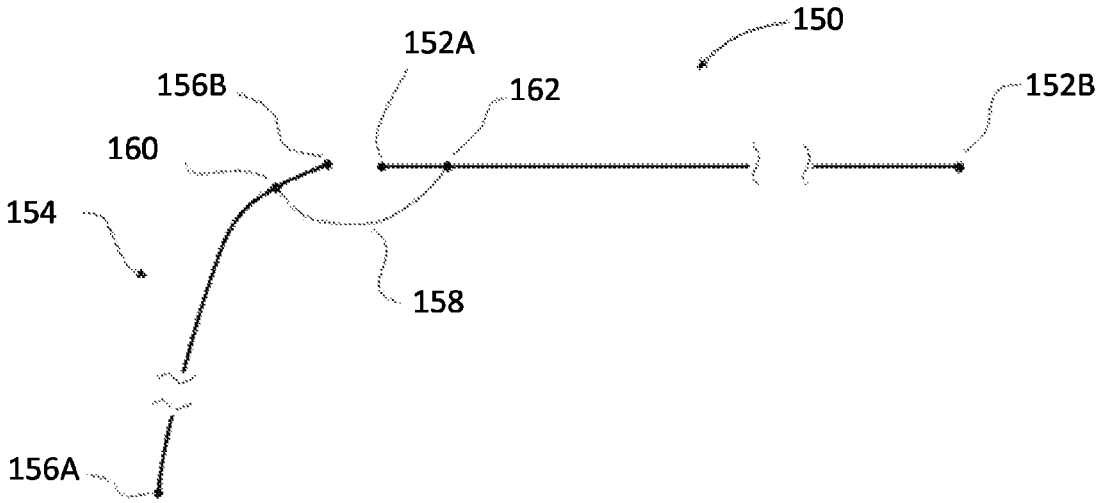

As shown in FIG. 1B, the inner terminal ends 32A, 32B of the first and second dipole sub-radiators 30A, 30B are directly connected to the outer terminal ends 44A, 44B of the first and second Vivaldi sub-radiators 40A, 40B. In the illustrated embodiment, these direct connections are a consequence of embodying the first dipole sub-radiator 30A and first Vivaldi sub-radiator 40A in a single piece of electrically conductive material and embodying the second dipole sub-radiator 30B and second Vivaldi sub-radiator 40B in a single piece of electrically conductive material. Embodying a dipole sub-radiator and a Vivaldi sub-radiator in separate pieces of material is feasible. With reference to FIGS. 6A and 6B, the establishment of an electrical connection between a dipole sub-radiator (or monopole) and a Vivaldi sub-radiator (or half-Vivaldi radiator) when the sub-radiators are initially fabricated as separate pieces is discussed. In FIG. 6A, a dipole sub-radiator 140 that extends from an inner terminal end 142A to an outer terminal end 142B is electrically connected to a Vivaldi sub-radiator 144 that extends from an inner terminal end 146A to an outer terminal end 146B. The inner terminal end 142A of the dipole sub-radiator 140 is electrically connected (via welding, soldering, or any other appropriate technique that results in an electrical connection) to the Vivaldi sub-radiator 144. The connection can be established at any location on the Vivaldi sub-radiator 144, provided the Vivaldi sub-radiator can still function as a feed for the dipole sub-radiator 140. In FIG. 6B, a dipole sub-radiator 150 that extends from an inner terminal end 152A to an outer terminal end 152B is electrically connected to a Vivaldi sub-radiator 154 that extends from an inner terminal end 156A to an outer terminal end 156B using a connector 158. The connector 158 establishes an electrical connection with the dipole sub-radiator 150 at location 162 and establishes an electrical connection with the Vivaldi sub-radiator 154 at location 160. The location 160 can be any location on the Vivaldi sub-radiator 154, provided the Vivaldi sub-radiator can still function as a feed for the dipole sub-radiator 150. The location 162 on the dipole sub-radiator 150 can also vary. However, the range for location 162 will typically extend from the inner terminal end 152A to locations that are close enough to the inner terminal end 152A that the connector 158 does not have substantial adverse impact on the operation of the antenna.

A number of variations in the components of the antenna structure can be made, provided the broadband characteristic attributable to dipole and Vivaldi modes of operation and low-profile characteristic of the antenna are maintained.

When the dipole radiator is comprised of two, planar sub-radiators and the antenna includes a single, planar ground plane, among the possible variations in the dipole radiator structure are: (a) the sub-radiators can be disposed parallel to the planar ground plane but disposed at different distances from the planar ground plane; (b) one or both of the sub-radiators can be disposed at an angle to the ground plane, and (c) the sub-radiators can be different lengths, i.e., the distance between the inner and outer terminal ends of one sub-radiator can be different than the distance between the inner and outer terminal ends of the other sub-radiator.

When the dipole radiator is comprised of two, planar sub-radiators and the antenna includes a ground plane comprised of two, ground sub-planes where one ground sub-plane is associated with one planar sub-radiator and the other ground sub-plane is associated with the other sub-radiator, among the possible variations in the dipole radiator structure are: (a) the ground sub-planes can be coplanar and the sub-radiators disposed parallel to their associated ground sub-planes but at different distances from their associated ground sub-planes, (b) the ground sub-planes can be disposed parallel to one another but not coplanar with one another and the sub-radiators can be disposed parallel to their associated ground sub-planes and at the same distance from their associated ground planes; (c) the ground sub-planes can be disposed parallel to one another but not coplanar with one another and the sub-radiators can be disposed parallel to their associated ground sub-planes but at different distances from their associated ground planes; (d) the ground sub-planes can be non-parallel to one another and the sub-radiators disposed parallel to their respective ground planes and at the same distance from their respective ground planes, and (e) the ground sub-planes can be non-parallel to one another and the sub-radiators disposed parallel to their respective ground planes but at different distances from their respective ground planes. In each of the foregoing cases, one or both of the sub-radiators can be disposed non-parallel to the their associated ground sub-plane.

When the dipole radiator is comprised of two sub-radiators and the antenna includes a single ground plane, a dipole mode of operation is feasible with one or both of the sub-radiators being non-planar (e.g., bent or curved) and/or the ground plane being non-planar.

A number of variations to the Vivaldi radiator are also feasible, provided the broadband characteristic attributable to dipole and Vivaldi modes of operation and low-profile characteristic of the antenna are maintained. In the illustrated embodiment, a line extending between the inner terminal ends 42A, 42B of the first and second Vivaldi sub-radiators 40A, 40B is substantially parallel to a line between the outer terminal ends 44A, 44B of the first and second Vivaldi sub-radiators 40A, 40B. Further, the first and second Vivaldi sub-radiators are substantially mirror images of one another, i.e., the Vivaldi radiator is symmetric with each of the sub-radiators conforming to the same plane curve that provides a Vivaldi mode of operation. Among the possible variations to the Vivaldi radiator is an asymmetric Vivaldi radiator. One characteristic of a type of one type of asymmetric Vivaldi radiator is that the two lines extending respectively between the inner terminal ends and outer terminal ends are oblique to one another, i.e., neither parallel or perpendicular to one another. Characteristic of another type of asymmetric Vivaldi radiator is that one of the Vivaldi sub-radiators conforms to one type of plane curve and the other Vivaldi sub-radiator conforms to a different type of Vivaldi plane curve. For example, one Vivaldi sub-radiator could conform to an exponential plane curve and the other Vivaldi sub-radiator could conform to a polynomial plane curve. A Vivaldi sub-radiator can also conform to two or more types of Vivaldi plane curves and be symmetric or asymmetric with the other Vivaldi sub-radiator. For example, a Vivaldi sub-radiator could conform to a Klopfenstein plane curve over a portion of the sub-radiator and a hyperbolic plane curve over a separate portion of the sub-radiator.

The foregoing description of the invention is intended to explain the best mode known of practicing the invention and to enable others skilled in the art to utilize the invention in various embodiments and with the various modifications required by their particular applications or uses of the invention.

What is claimed is:

1. A broadband, low-profile antenna structure comprising:

a compound radiator comprising a dipole radiator portion and a Vivaldi radiator portion;

the dipole radiator portion comprising a first dipole sub-radiator and a second dipole sub-radiator that is separated from the first dipole sub-radiator, the first and second dipole sub-radiators substantially forming the dipole radiator portion of the compound radiator;

the first and second dipole sub-radiators each extending from an inner dipole sub-radiator terminal end to an outer dipole sub-radiator terminal end;

the inner dipole sub-radiator terminal ends are both located between the outer dipole sub-radiator terminal ends and separated by a first dipole distance;

the outer dipole sub-radiator terminal ends are separated by a second dipole distance that is greater than the first dipole distance;

the Vivaldi radiator portion comprising a first Vivaldi sub-radiator and a second Vivaldi sub-radiator that is separated from the first Vivaldi sub-radiator, the first and second Vivaldi sub-radiators substantially forming the Vivaldi radiator portion of the compound radiator;

the first and second Vivaldi sub-radiators each define a plane curve that extends from an inner Vivaldi sub-radiator terminal end to an outer Vivaldi sub-radiator terminal end;

the inner Vivaldi sub-radiator terminal ends are separated by a first Vivaldi distance and present a desired impedance over a bandwidth;

the outer Vivaldi sub-radiator terminal ends are separated by a second Vivaldi distance that is greater than the first Vivaldi distance;

wherein the first dipole sub-radiator is electrically connected to the first Vivaldi sub-radiator at a location other than the inner Vivaldi sub-radiator terminal end of the first Vivaldi sub-radiator, and between the inner Vivaldi sub-radiator terminal end and the outer Vivaldi sub-radiator terminal end of the first Vivaldi sub-radiator or at the outer Vivaldi sub-radiator terminal end of the first Vivaldi sub-radiator;

wherein the second dipole sub-radiator is electrically connected to the second Vivaldi sub-radiator at a location other than the inner Vivaldi sub-radiator terminal end of the second Vivaldi sub-radiator, and located between the inner Vivaldi sub-radiator terminal end and the outer Vivaldi sub-radiator terminal end of the second Vivaldi sub-radiator or at the outer Vivaldi sub-radiator terminal end of the second Vivaldi sub-radiator;

a ground plane disposed adjacent to the compound radiator;

wherein, in operation, the antenna structure operates over a bandwidth in which the ratio of the highest frequency ($f_{high}$) in the bandwidth to the lowest frequency ($f_{low}$) in the bandwidth is at least 3:1, the dipole radiator portion operating in the lower frequency portion of the bandwidth and the Vivaldi radiator portion acting as a feed for transmitting/receiving electrical signals to/from the dipole radiator portion when the dipole radiator portion is operating in the lower frequency portion of the bandwidth, and the Vivaldi radiator portion for operating in the upper frequency portion of the bandwidth;

wherein the distance between any radiator point associated with either the dipole radiator portion or the Vivaldi radiator portion and a ground point associated with the ground plane that is the nearest point on the ground plane to such radiator point is less than $\lambda/2$ at $f_{low}$.

2. A broadband, low-profile antenna structure, as claimed in claim 1, wherein:

the second dipole distance is in a range extending from and including $\lambda/4$ at $f_{low}$ to and including $\lambda/2$ at $f_{low}$.

3. A broadband, low-profile antenna structure, as claimed in claim 1, wherein:

the second Vivaldi distance is less than $\lambda/2$ at $f_{low}$.

4. A broadband, low-profile antenna structure, as claimed in claim 1, wherein:

the second Vivaldi distance is substantially equal to the first dipole distance.

5. A broadband, low-profile antenna structure, as claimed in claim 1, wherein:

a first line extending between the outer Vivaldi terminal ends is substantially parallel to a second line extending between the inner Vivaldi terminal ends.

6. A broadband, low-profile antenna structure, as claimed in claim 1, wherein:

a first line extending between the outer Vivaldi terminal ends and a second line extending between the inner Vivaldi terminal ends are oblique.

7. A broadband, low-profile antenna structure, as claimed in claim 1, wherein:

the first Vivaldi sub-radiator defines a first plane curve and the second Vivaldi sub-radiator defines a second plane curve;

wherein the first plane curve includes one of: a linear, exponential, Klopfenstein, elliptical, polynomial, trigonometric, and hyperbolic curve;

wherein the second plane curve includes a different one of: a linear, exponential, Klopfenstein, elliptical, polynomial, trigonometric, and hyperbolic curve.

8. A broadband, low-profile antenna structure, as claimed in claim 1, wherein:

the first Vivaldi sub-radiator defines a first plane curve having a first plane curve portion and a second plane curve portion;

wherein the first plane curve portion includes one of: a linear, exponential, Klopfenstein, elliptical, polynomial, trigonometric, and hyperbolic curve;

wherein the second plane curve portion includes a different one of: a linear, exponential, Klopfenstein, elliptical, polynomial, trigonometric, and hyperbolic curve.

9. A broadband, low-profile antenna structure, as claimed in claim 1, wherein:

the inner dipole sub-radiator terminal end of the first dipole sub-radiator is substantially directly connected to the first Vivaldi sub-radiator at a location that is other than the inner terminal end of the first Vivaldi sub-radiator.

10. A broadband, low-profile antenna structure, as claimed in claim 1, further comprising:

an electrical connector that connects the first dipole sub-radiator to the first Vivaldi sub-radiator at a location that is other than the inner terminal end of the first Vivaldi sub-radiator.

11. A broadband, low-profile antenna structure, as claimed in claim 1, further comprising:

a first ground-dipole connection for electrically connecting a first ground plane terminal end to one of the outer dipole sub-radiator terminal ends; and a second ground-dipole connection for electrically connecting a second ground plane terminal end to the other outer dipole sub-radiator terminal ends.

12. A broadband, low-profile antenna structure, as claimed in claim 11, wherein:

the first and second ground-dipole connections each have at least one of a resistive, capacitive, and inductive characteristic.

13. A broadband, low-profile antenna structure comprising:

a compound radiator comprising a dipole radiator portion and a Vivaldi radiator portion;

the dipole radiator portion comprising a first dipole sub-radiator and a second dipole sub-radiator that is separated from the first dipole sub-radiator, the first and second dipole sub-radiators substantially forming the dipole radiator portion of the compound radiator;

the first and second dipole sub-radiators each extending from an inner dipole sub-radiator terminal end to an outer dipole sub-radiator terminal end;

the inner dipole sub-radiator terminal ends are both located between the outer dipole sub-radiator terminal ends and separated by a first dipole distance;

the outer dipole sub-radiator terminal ends are separated by a second dipole distance that is greater than the first dipole distance;

the Vivaldi radiator portion comprising a first Vivaldi sub-radiator and a second Vivaldi sub-radiator that is separated from the first Vivaldi sub-radiator, the first and second Vivaldi sub-radiators substantially forming the Vivaldi radiator portion of the compound radiator;

the first and second Vivaldi sub-radiators each define a plane curve that extends from an inner Vivaldi sub-radiator terminal end to an outer Vivaldi sub-radiator terminal end;

the inner Vivaldi sub-radiator terminal ends are separated by a first Vivaldi distance and present a desired impedance over a bandwidth;

the outer Vivaldi sub-radiator terminal ends are separated by a second Vivaldi distance that is greater than the first Vivaldi distance;

wherein the first dipole sub-radiator is electrically connected to the first Vivaldi sub-radiator at a location other than the inner Vivaldi sub-radiator terminal end of the first Vivaldi sub-radiator;

wherein the second dipole sub-radiator is electrically connected to the second Vivaldi sub-radiator at a location other than the inner Vivaldi sub-radiator terminal end of the second Vivaldi sub-radiator;

a ground plane disposed adjacent to the compound radiator;

wherein, in operation, the antenna structure operates over a bandwidth in which the ratio of the highest frequency (fhigh) in the bandwidth to the lowest frequency (flow) in the bandwidth is at least 3:1, the dipole radiator portion operating in the lower frequency portion of the bandwidth and the Vivaldi radiator portion acting as a feed for transmitting/receiving electrical signals to/from the dipole radiator portion when the dipole radiator portion is operating in the lower frequency portion of the bandwidth, and the Vivaldi radiator portion for operating in the upper frequency portion of the bandwidth;

wherein the distance between any radiator point associated with either the dipole radiator portion or the Vivaldi radiator portion and a ground point associated with the ground plane that is the nearest point on the ground plane to such radiator point is less than $\lambda/2$ at $f_{low}$;

the inner dipole sub-radiator terminal end of the first dipole sub-radiator is substantially directly connected to the outer Vivaldi sub-radiator terminal end of the first Vivaldi sub-radiator.

14. A broadband, low-profile antenna structure, as claimed in claim 13, wherein:

the inner dipole sub-radiator terminal end of the second dipole sub-radiator is substantially directly connected to the outer Vivaldi sub-radiator terminal end of the second Vivaldi sub-radiator.

15. A broadband, low-profile antenna structure, as claimed in claim 13, wherein:

the inner dipole sub-radiator terminal end of the second dipole sub-radiator is substantially directly connected to the outer Vivaldi sub-radiator at a location that is between the inner Vivaldi sub-radiator terminal end and the outer Vivaldi sub-radiator terminal end of the second Vivaldi sub-radiator.

16. A broadband, low-profile antenna structure comprising:

a compound radiator comprising a dipole radiator portion and a Vivaldi radiator portion that is electrically connected to the dipole radiator portion;

the dipole radiator portion comprising a first dipole sub-radiator and a second dipole sub-radiator that is separated from the first dipole sub-radiator;

wherein each of the first and second dipole sub-radiators extends from an inner dipole sub-radiator terminal end to an outer dipole sub-radiator terminal end;

the Vivaldi radiator portion comprises a first Vivaldi sub-radiator and a second Vivaldi sub-radiator that is separated from the first Vivaldi sub-radiator;

wherein each of the first and second Vivalid sub-radiators defines a plane curve that extends from an inner Vivaldi sub-radiator terminal end to an outer Vivaldi sub-radiator terminal end;

wherein the inner dipole sub-radiator terminal end of the first dipole sub-radiator is electrically connected to the first Vivaldi sub-radiator at a location other than the inner Vivaldi sub-radiator terminal end, and between the inner Vivaldi sub-radiator terminal end and the outer Vivaldi sub-radiator terminal end of the first Vivaldi sub-radiator or at the outer Vivaldi sub-radiator terminal end of the first Vivaldi sub-radiator;

wherein the inner dipole sub-radiator terminal end of the second dipole sub-radiator is electrically connected to the second Vivaldi sub-radiator at a location other than the inner Vivaldi sub-radiator terminal end, and between the inner Vivaldi sub-radiator terminal end and the outer Vivaldi sub-radiator terminal end of the second Vivaldi sub-radiator or at the outer Vivaldi sub-radiator terminal end of the second Vivaldi sub-radiator;

a ground plane disposed adjacent to the compound radiator;

wherein, in operation, the antenna structure operates over a bandwidth in which the ratio of the highest frequency ($f_{high}$) in the bandwidth to the lowest frequency ($f_{low}$) in the bandwidth is at least 3:1, the dipole radiator portion operating in the lower frequency portion of the bandwidth and the Vivaldi radiator portion acting as a feed for transmitting/receiving electrical signals to/from the dipole radiator portion when the dipole radiator portion is operating in the lower frequency portion of the bandwidth, and the Vivaldi radiator portion operating in the upper frequency portion of the bandwidth;

wherein the distance between any radiator point associated with either the dipole radiator portion or the Vivaldi radiator portion and a ground point associated with the ground plane that is the nearest point on the ground plane to such radiator point is less than $\lambda/2$ at $f_{low}$.

17. A broadband, low-profile antenna structure, as claimed in claim 16, wherein:

at least one of the first and second dipole sub-radiators comprising one of: (a) a wire, (b) triangular shape, and (c) isosceles trapezoidal shape.

18. A broadband, low-profile antenna structure, as claimed in claim 16, wherein:

at least one of the first and second Vivaldi sub-radiators comprising one of: (a) a wire that substantially conforms to the plane curve, (b) a planar surface with a boundary that substantially conforms the plane curve, (c) a flared surface and with at least a portion of the flared surface defining a line that substantially conforms to the plane curve and with the width of the flared surface at two points on and perpendicular to the line being different.

19. A broadband, low-profile antenna structure, as claimed in claim 16, wherein:

wherein at least the first dipole sub-radiator and the first Vivaldi sub-radiator are embodied in a single piece of material.

20. A broadband, low-profile antenna structure, as claimed in claim 19, wherein:

the first dipole sub-radiator, second dipole sub-radiator, first Vivaldi sub-radiator, second Vivaldi sub-radiator, and ground plane are embodied in a single piece of material.

21. A broadband, low-profile antenna structure comprising:

a compound radiator comprising a half-Vivaldi radiator portion and a monopole radiator portion that is electrically connected to the half-Vivaldi radiator;

the monopole radiator portion extends from an inner monopole radiator portion terminal end to an outer monopole radiator portion terminal end;

the half-Vivaldi radiator portion defines a plane curve that extends from an inner half-Vivaldi radiator portion terminal end to an outer half-Vivaldi radiator portion terminal end;

wherein the inner monopole radiator portion terminal end is electrically connected to the half-Vivaldi radiator portion at a location other than the inner half-Vivaldi radiator portion terminal end, and between the inner half-Vivaldi radiator portion terminal end and the outer half-Vivaldi radiator portion terminal end or at the outer half-Vivaldi radiator portion terminal end;

a ground plane disposed adjacent to the compound radiator;

wherein, in operation, the antenna structure operates over a bandwidth in which the ratio of the highest frequency ($f_{high}$) in the bandwidth to the lowest frequency ($f_{low}$) in the bandwidth is at least 3:1, the monopole radiator portion operating in the lower frequency portion of the bandwidth and the half-Vivaldi radiator portion acting as a feed for transmitting/receiving electrical signals to/from the monopole radiator portion when the monopole radiator portion is operating in the lower frequency portion of the bandwidth, and the half-Vivaldi radiator portion operating in the upper frequency portion of the bandwidth;

wherein the distance between any radiator point associated with either the dipole radiator portion or the Vivaldi radiator portion and a ground point associated with the ground plane that is the nearest point on the ground plane to such radiator point is less than $\lambda/2$ at $f_{low}$.

22. A broadband, low-profile antenna structure, as claimed in claim 21, where:

the ground plane comprising a first ground plane portion and a second ground plane portion that is spaced from the first ground plane portion;

wherein the first ground plane portion is located in a range that is ±90° from being coplanar with the second ground plane portion.

* * * * *

UNITED STATES PATENT AND TRADEMARK OFFICE

CERTIFICATE OF CORRECTION

PATENT NO. : 9,257,748 B1
APPLICATION NO. : 13/836699
DATED : February 9, 2016
INVENTOR(S) : Arian C. Lalezari et al.

It is certified that error appears in the above-identified patent and that said Letters Patent is hereby corrected as shown below:

In the Claims

At claim 15, col. 11, line 17, delete “outer”, and insert --the second--.

Signed and Sealed this
Third Day of May, 2016

Michelle K. Lee

Michelle K. Lee
*Director of the United States Patent and Trademark Office*